United States Patent [19]

Willett

[11] 3,938,804

[45] Feb. 17, 1976

[54] SAFETY BASE FOR ATHLETIC EVENTS

[76] Inventor: Arthur Eugene Willett, 5902 Arapahoe Terrace, Forest Heights, Md. 20021

[22] Filed: Apr. 17, 1975

[21] Appl. No.: 569,304

Related U.S. Application Data

[63] Continuation-in-part of Ser. No. 415,835, Dec. 10, 1973, abandoned.

[52] U.S. Cl. ..... 273/25

[51] Int. Cl.[2] ..... A63B 69/40

[58] Field of Search ..... 273/25

[56] References Cited

UNITED STATES PATENTS

| | | | |
|---|---|---|---|
| 2,756,999 | 7/1956 | Orsatti | 273/25 |
| 3,330,053 | 7/1967 | Hendrix | 273/137 |
| D214,743 | 7/1969 | Geoders | D35/5 GP |

FOREIGN PATENTS OR APPLICATIONS

| | | | |
|---|---|---|---|
| 553,148 | 3/1923 | France | 178/5 |

*Primary Examiner*—Richard C. Pinkham
*Assistant Examiner*—T. Brown
*Attorney, Agent, or Firm*—Shoemaker and Mattare, Ltd.

[57] ABSTRACT

A safety base for athletic events, particularly for the first base position of softball and baseball playing fields, includes a first portion of conventional size and shape for conventional placement in the infield at first base position, and an integral, extended, colorcoded portion for placement across and outside the base line, whereby an extended portion of the base is available to a player running toward first base, which the player may tag in order to be safe, and thus the danger of collision with another player attempting to tag the first player out at first base is substantially reduced, with a resultant reduction in the incidence of injury to either of the players.

4 Claims, 3 Drawing Figures

SAFETY BASE FOR ATHLETIC EVENTS

BACKGROUND OF THE INVENTION

This application is a continuation-in-part of Applicataion Ser. No. 415,835, filed Dec. 10, 1973, now abandoned.

This invention relates to a safety base for athletic events, and in particular to an extended base for the first base position on softball and baseball playing fields.

Practically since the inception of the games of baseball and softball the bases and general dimensions and layout of the playing fields have been unchanged, and at least for the past 30 or 40 years the bases and other dimensions have remained substantially the same. Heretofore, conventional bases used in the game of softball or baseball are typically 15 inches square and from 3 to 5 inches thick, according to official softball and baseball rules, and are padded and made of suitable materials to withstand the rough usage frequently encountered in the game. In baseball, for example, a distance of 90 feet exists between home plate and first base, and for the last 45 feet between home plate and first base a 3 foot wide running lane is provided outside the foul line or base line. First base, on the other hand, is disposed wholly in the infield, and since prior art conventional bases are only 15 inches square, a relatively small area is provided for tagging by the runner and/or by the fielder attempting to make a play at first base. Thus, in the distance of 90 feet, the runner attains full speed and he generally runs in the 3 foot running lane provided outside the base line. Consequently, the runner will frequently turn infield immediately before reaching first base in order to be sure to tag or touch the base. However, the fielder or other player may either be standing on the base and attempting to catch a ball thrown with great speed toward the base to get the runner out, or the fielder will also be running at full speed toward first base in order to beat the runner there and thus get the runner out. Thus, a very dangerous situation is created in which the possibility of collision between the runner and first baseman or fielder is very great. The problem is particularly acute when amateurs are playing, such as in the many youth leagues around the world, wherein relatively unskilled young people are encouraged to play the sports of softball and baseball. These young people are frequently not as well coordinated as more mature people and, therefore, the danger of collision between a runner and a first baseman or fielder is enhanced. Consequently, the incidence of injury between players at the first base position is quite high.

OBJECTS OF THE INVENTION

Therefore, it is an object of this invention to provide a safety base for athletic events, and particularly for the first base position of softball and baseball playing fields, and wherein the safety base has an extended end portion projecting outwardly of the base line into the 3 foot running area, whereby a player running toward the base has available to him an extended portion which he may tag, thus eliminating the necessity of the runner of turning inwardly toward the portion of the base disposed in the infield area, and thus substantially reducing the danger of collision between the runner and a fielder attempting to get the runner out at first base.

DETAILED DESCRIPTION OF THE INVENTION

Figure 1:
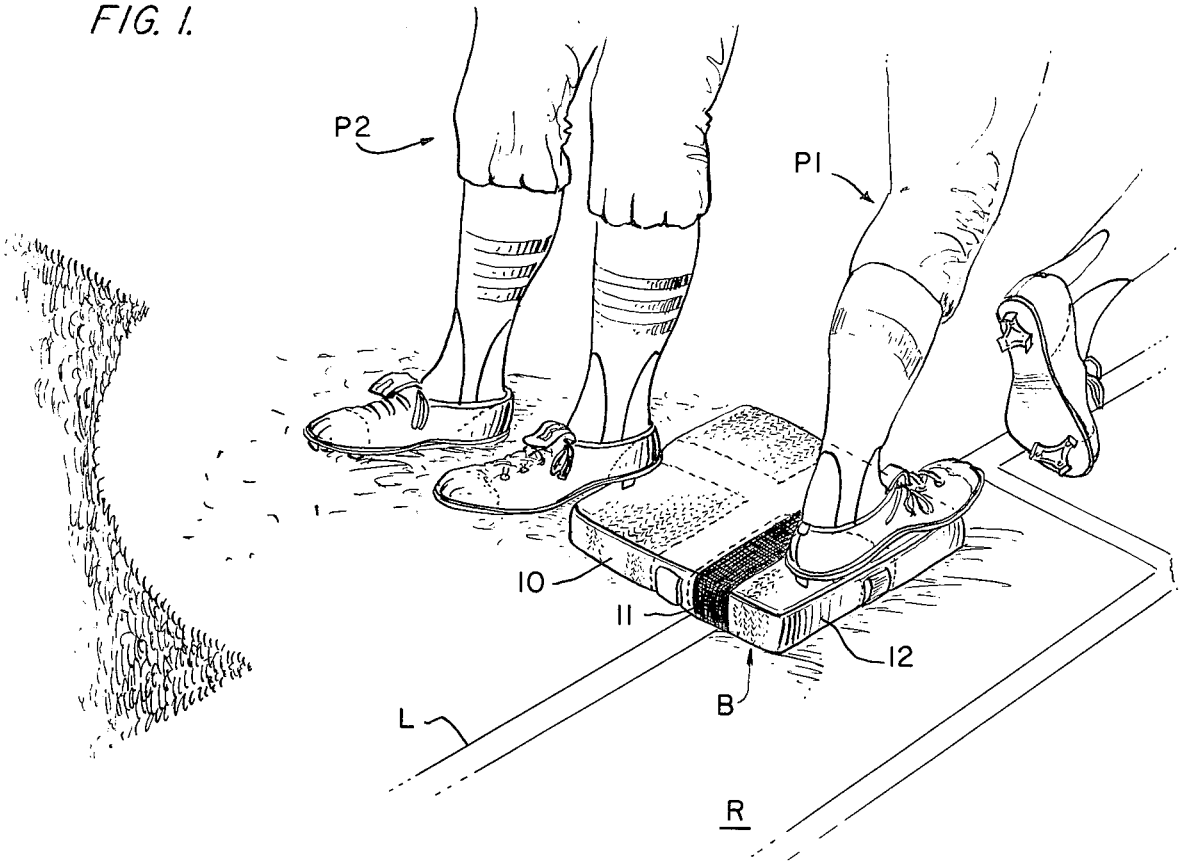
FIG. 1 is a perspective view illustrating the manner in which the extended safety base of the invention is used.
Figure 2:
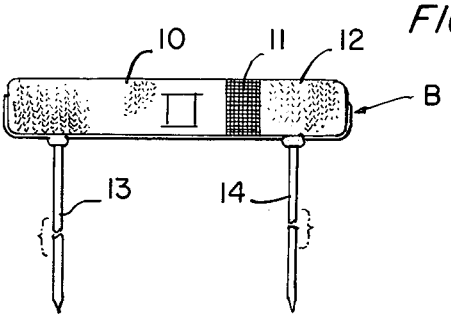
FIG. 2 is a view in elevation of the safety base of the invention.

In the drawings, wherein like reference numerals indicate like parts throughout the several views, a safety base B in accordance with the invention is shown in position on a playing field, and the safety base B includes a first portion 10 of substantially conventional size and shape disposed in the infield area at the first base position, a second portion 11 which coincides with the base line L, and a third portion 12 which projects outwardly of the base line L into the running area or lane R extending along the base line.

The base B is of one-piece construction, and is made of a suitable durable material, such as conventionally used in the manufacture of conventional bases, and may comprise, for example, a vinyl, nylon, canvas or other suitable covering, having a wood-wool stuffing or foam padding and the like, with web straps and metal spikes and/or metal pegs or peg connectors with metal sleeves positioned on the bottom of the base, as desired.

In the example shown, a pair of pegs 13 and 14 are suitably attached to the underside of base B adjacent opposite end portions thereof, whereby the pegs may be inserted into the ground to firmly anchor the base in position.

The first portion 10 preferably is square in shape and has a length and width each of about 15 inches and a thickness of from 3 to 5 inches. The second portion 11 has the same width of 15 inches, but has a length of only 4 inches, and the third portion 12 also has the same width of 15 inches, but has a length of 6 inches. Thus, the base has a first end portion M of substantially conventional size and shape and a second, or extended, end portion N which is adapted to extend over and outwardly of the base line L. Moreover, the first and third portions 10 and 12 are preferably white or off-white in color, and the second portion 11 is preferably black in color, such that the different sections or portions of the base are clearly distinguished for the purpose of establishing certain areas for rules regarding the use of the extended safety base.

Figure 3:
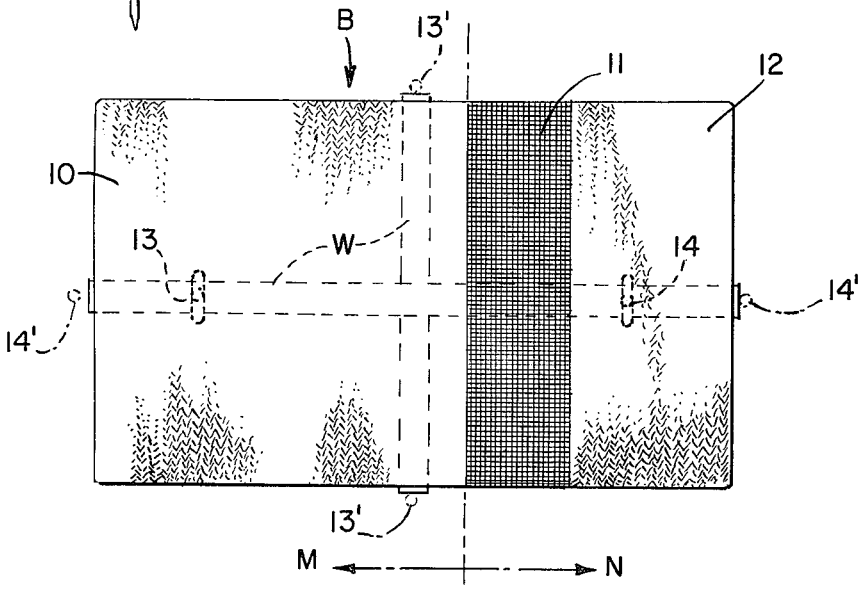
FIG. 3 is an enlarged, plan view of the safety base of the invention.

The optional provision of pegs or spikes 13' and 14' at substantially the center of each of the opposite sides and opposite ends, respectively, of the base is indicated in dot and dash lines in FIG. 3. Also, suitable webbing W is provided on the base to help retain the shape of the base.

Thus in use, the base B is positioned at the first base position of either a softball or baseball playing field, as shown in FIG. 1, with the second portion 11 coinciding with the base line L and the first portion 10 disposed in the infield area, and the third portion 12 disposed outwardly of the base line L in the 3 foot running lane R. Accordingly, when a play is made at first base, the runner P1 is enabled to stay in the 3 foot running lane R and may tag the extended end portion 12 without creating an excessive danger of collision with the fielder P2, who may tag or touch the first portion or infield area 10 of the base. By the present invention it will be seen that a safe distance is left between a runner and fielder at the first base position, which thus substantially reduces the danger of collision between the runner and fielder, and yet the integrity of the game is not harmed.

It is recognized that the official rules, both for professional and amateur sport, would need to be changed in order to use the base according to the present invention, but in view of the added safety to the players involved, and further in view of the fact that the nature and style of the game would not otherwise be changed or effected, it is not seen that this will create any undue hardship or problems in the use of the invention.

Also, not only will the present invention substantially reduce the danger of collision between a fielder and runner at first base, and consequently reduce the injuries between the players, but will also afford the first baseman more flexibility in making a play at first base, and will also enable better management training of novice or beginner players in running toward first base and making plays at that base. In other words, less emphasis can be placed on attempting to avoid collisions with other players, and more emphasis placed on learning the basics of the game and in attempting to reach first base at full speed in order either to be safe to to make a play at that base.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A safety base for the first base position of softball and baseball playing fields, comprises an elongate, rectangularly shaped base having a first end portion of the size and shape of a conventional softball and baseball base for disposition in a conventional position in the infield at the first base position, an integral, extended end portion for placement across and outside the base line to thus present an extended end portion of the base to a player running toward the base, which extended end portion may be tagged by the runner, thereby significantly reducing the danger of collision between the runner and another player attempting to get the runner out at the base, said extended end portion comprising a second portion which has a length substantially the same as the width of the base line and is adapted to overlie the base line, and a third portion which is adapted to extend outwardly of the base line, said first and third portions being readily visually distinguishable one from the other and said second portion being readily visually distinguishable from the first and third portions.

2. A safety base as in claim 1, wherein the first end portion is approximately 15 inches long, the second portion is approximately 4 inches long, and the third portion is approximately 6 inches long, all of said portions having a width of 15 inches.

3. A safety base as in claim 2, wherein said first and third portions are of one color and said second portion is of another color.

4. A safety base as in claim 3, wherein the base is from 3 to 5 inches thick, and said one color is white and said another color is black.

* * * * *